US006944899B2

(12) United States Patent
Gladney

(10) Patent No.: US 6,944,899 B2
(45) Date of Patent: Sep. 20, 2005

(54) STRANDED MATTRESS SPRING

(75) Inventor: Richard F. Gladney, Fairburn, GA (US)

(73) Assignee: Dreamwell, Ltd., Las Vegas, NV (US)

( * ) Notice: Subject to any disclaimer, the term of this patent is extended or adjusted under 35 U.S.C. 154(b) by 0 days.

(21) Appl. No.: 10/688,852

(22) Filed: Oct. 15, 2003

(65) Prior Publication Data

US 2004/0158930 A1 Aug. 19, 2004

Related U.S. Application Data

(63) Continuation-in-part of application No. 10/371,177, filed on Feb. 19, 2003.

(51) Int. Cl.[7] ..... A47C 23/04; A47C 27/20; F16F 1/06; F16F 3/093

(52) U.S. Cl. ..... 5/716; 5/718; 5/720; 5/655.7; 5/655.8; 5/256; 267/180

(58) Field of Search ..... 5/716, 654.1, 655.7, 5/642, 256, 720, 718, 655.8; 267/166, 167, 180

(56) References Cited

U.S. PATENT DOCUMENTS

| | | | | |
|---|---|---|---|---|
| 15,869 A | | 10/1856 | French | |
| 99,475 A | | 2/1870 | Rhinelander | |
| 274,715 A | | 3/1883 | Buckley | |
| 374,658 A | | 12/1887 | Collom | |
| 683,344 A | | 9/1901 | Sim | |
| 685,160 A | | 10/1901 | Marshall | |
| 837,751 A | * | 12/1906 | Summers | 5/246 |
| 1,192,510 A | * | 7/1916 | Fischmann | 5/655.8 |
| 1,451,936 A | | 4/1923 | Young | |
| 1,493,179 A | | 5/1924 | Young et al. | |
| 1,544,237 A | | 6/1925 | Karr | |
| 2,398,237 A | * | 4/1946 | Marsack | 5/718 |
| 3,985,097 A | | 10/1976 | Sitton | |
| 4,473,217 A | | 9/1984 | Hashimoto | |
| 4,753,423 A | | 6/1988 | Ukai et al. | |
| 4,811,439 A | | 3/1989 | Siegel | |
| 4,869,471 A | | 9/1989 | Schwarz et al. | |
| 4,889,327 A | | 12/1989 | Seyler | |
| 4,983,144 A | | 1/1991 | Ojima | |
| 4,991,827 A | | 2/1991 | Taylor | |
| 5,098,493 A | | 3/1992 | Taylor | |
| 5,210,890 A | | 5/1993 | Hagglund | |
| 5,310,167 A | | 5/1994 | Noll, Jr. | |
| 4,889,327 A | | 12/1994 | Seyler | |
| 5,548,898 A | | 8/1996 | Noll, Jr. | |
| 5,756,022 A | | 5/1998 | Siegel | |
| 5,868,383 A | * | 2/1999 | Codos | 267/80 |
| 6,220,586 B1 | | 4/2001 | Pavlin et al. | |
| 6,295,891 B1 | | 10/2001 | Velte et al. | |
| 2004/0158929 A1 | * | 8/2004 | Gladney | 5/716 |
| 2004/0158930 A1 | * | 8/2004 | Gladney | 5/716 |
| 2005/0005354 A1 | * | 1/2005 | Gladney et al. | 5/256 |

FOREIGN PATENT DOCUMENTS

| | | |
|---|---|---|
| DE | 815 907 | 10/1951 |
| DE | 002620149 B1 | 11/1977 |
| GB | 000020583 | of 1911 |
| JP | 357069123 A | 4/1982 |
| JP | 357069125 A | 4/1982 |
| JP | 357069126 A | 4/1982 |

OTHER PUBLICATIONS

Wallingford Bicycle Parts (http://www.wallbike.com/Products.html) The BROOKS B.33 Saddle.

The Deactivated Gun Collector's Association (SIG–Sauer P225).

* cited by examiner

*Primary Examiner*—Robert G. Santos
(74) *Attorney, Agent, or Firm*—Fish & Neave IP Group, Ropes & Gray, LLP

(57) ABSTRACT

A mattress construction with a multi-strand coil spring is disclosed. The multi-strand coil spring can be designed with the same performance characteristic as a conventional solid wire coil spring, but at a lower manufacturing and material cost.

23 Claims, 5 Drawing Sheets

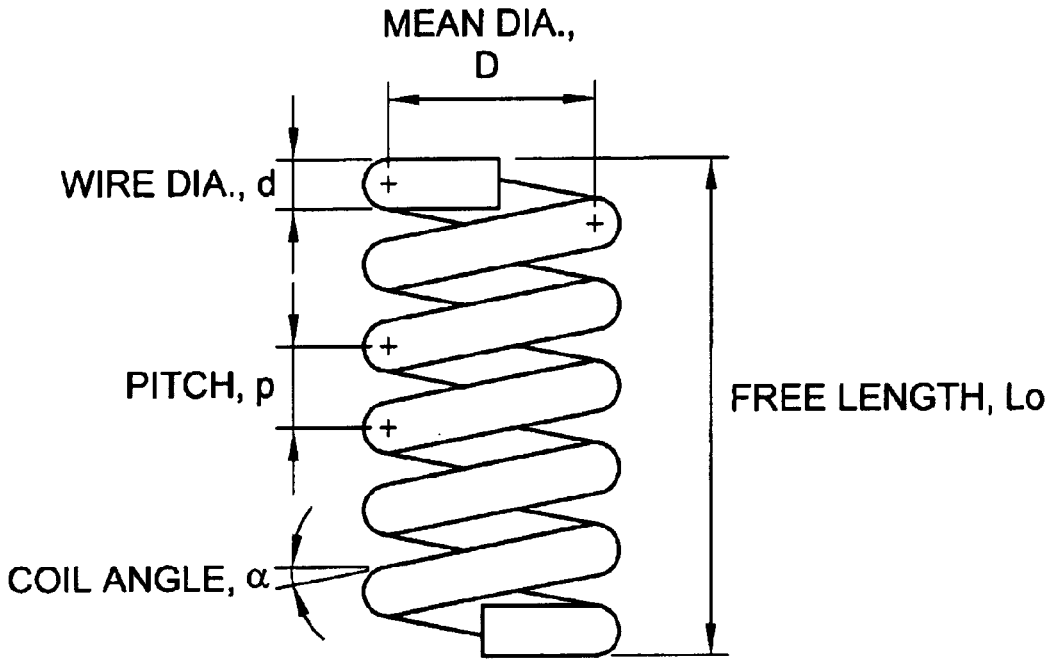
Figure 1, Conventional Compression Spring
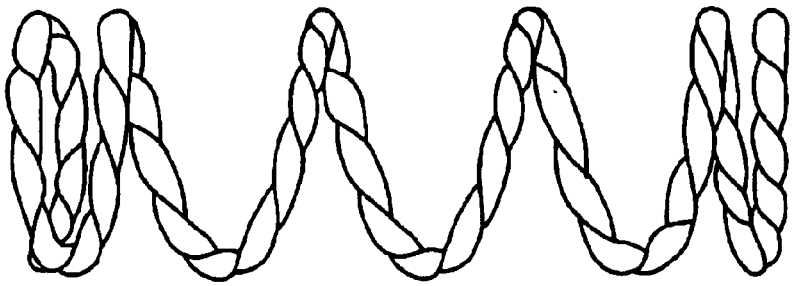
Figure 2, Stranded Wire Coil

STRANDED MATTRESS SPRING

CROSS-REFERENCE TO OTHER PATENT APPLICATIONS

This application is a continuation-in-part of U.S. patent application Ser. No. 10/371,177, filed Feb. 19, 2003, the subject matter of which is incorporated herein by reference in its entirety.

BACKGROUND OF THE INVENTION

A standard bed construction which has been popular for some time includes a frame for supporting a box spring. The box spring, in turn, is designed to support a mattress. Mattresses are available in a variety of sizes and are also constructed in various ways. One such construction which has proved to be highly desirable includes the use of an innerspring comprising a plurality of discrete coil springs which can be encapsulated in individual fabric pockets joined together in a string. An assembly of this type is known as Marshall construction and is disclosed, for example, in U.S. Pat. No. 4,234,983, issued to Stumpf, the disclosure of which is incorporated herein by reference. Once the strings of coils are formed, they may be arranged in any desired fashion such as a chevron or other pattern to provide an innerspring assembly in which the individual springs all have longitudinal axes oriented parallel one to another and the springs are closely packed together in an array having a generally rectangular shape in plan with the ends of the springs lying in a common plane. A suitable quilted foam pad of preselected thickness may then be used to cover the innerspring and provide a generally planar surface on which a person can sleep. Preferably, the innerspring is covered on both sides and has fabric edging connecting the opposed surface covers, thereby defining a unitary mattress assembly.

Each coil is typically manufactured from a single steel wire that is coiled using an apparatus disclosed, for example, in U.S. Pat. No. 4,401,501 also issued to Stumpf, the disclosure of which is likewise incorporated herein by reference. The spring characteristic is defined, among others, by the wire size and spring dimensions (pitch, coil length, coil diameter, etc.) which can be selected according to the desired properties of the seating or resting surface of the article of furniture or mattress in a manner known in the art.

Although coils of the aforedescribed type have been used almost exclusively in the construction of seating or resting surfaces, they are not inexpensive and severely impair the seating or sleeping comfort if one or more springs malfunction, for example, break.

It would therefore be desirable to provide a spring construction that is less expensive to manufacture than a solid wire spring while retaining the advantageous performance characteristic of the solid wire speing.

SUMMARY OF THE INVENTION

The invention is directed to a spring support for a seating or resting surface for an article of furniture, and more particularly to a multi-strand wire coil and a mattress assembly with a multi-strand wire coil.

According to one aspect of the invention, a mattress assembly includes a plurality of coil springs arranged to define a mattress core structure, and additional multi-strand coil springs fabricated of a plurality of wire strands and disposed inside or around the coil springs of the mattress core structure.

According to another aspect of the invention, a mattress assembly includes a plurality of coil springs arranged to define a mattress core structure, wherein at least a subset of the coil springs are multi-strand coil springs fabricated of a plurality of wire strands and positioned in substantially parallel alignment to each of the coil springs that are not part of the subset. The multi-strand coil springs and the coil springs that are not part of the subset are placed side-by-side.

According to yet another aspect of the invention, a mattress assembly includes a plurality of coil springs arranged to define a mattress core structure, wherein at least a subset of the coil springs comprises a composite coil spring, with a first section of the composite coil spring being fabricated of a plurality of wire strands and a second section of the composite coil spring adjoining the first section in a longitudinal spring direction being fabricated of a solid coil wire. Adjoining end portions of the first and second section are rigidly connected with each other.

Additional embodiments may include one or more of the following features. The coil spring forming the mattress core can be solid wire springs or multi-strand coil springs, and the coil springs can have different spring rates. The coil springs can also have a variable, such as a non-linear and/or progressive spring rate. At least one strand of the wire strands of the multi-strand coil springs can be made of a different material than another wire strand, for example, steel, bronze and/or a suitable plastic. To add support and simplify manufacturing, at least a portion of the coil springs and the multi-strand coil springs can be surrounded by a foam or rubber-like material. Alternatively, the entire mattress core can be encased in the foam or rubber-like material.

The sections of the composite spring can be connected with each other by placing a bushing over the end sections or by welding, brazing or other joining techniques known in the art. The multi-strand wire in the coil construction can include stranded wire produced by twisting the individual strands around a common imaginary axis and/or braided wire.

The multi-strand/braided wire can also be used as border wire, either separately or in conjunction with the aforedescribed multi-strand coil springs. The multi-strand coil springs can also be implemented as pocketed springs.

To lessen the adverse effects caused by rubbing of the strands against each other and wear, the strands can be coated before being multi-strand, for example, with Teflon or another material that reduces friction and can withstand the processing temperatures (annealing) of the multi-strand wires. Moreover, the strands can be protected by a metallurgical process, such as galvanization, while the multi-strand wires can be overcoated in addition with a plastic coating for additional protection against the environment.

Further features and advantages of the present invention will be apparent from the following description of preferred embodiments and from the claims.

BRIEF DESCRIPTION OF THE DRAWINGS

The following figures depict certain illustrative embodiments of the invention in which like reference numerals refer to like elements. These depicted embodiments are to be understood as illustrative of the invention and not as limiting in any way.

FIG. 1 shows schematically a conventional closed end coil spring;

FIG. 2 shows schematically an embodiment of a multi-strand coil spring; and

DETAILED DESCRIPTION OF CERTAIN ILLUSTRATED EMBODIMENTS

Figure 3:
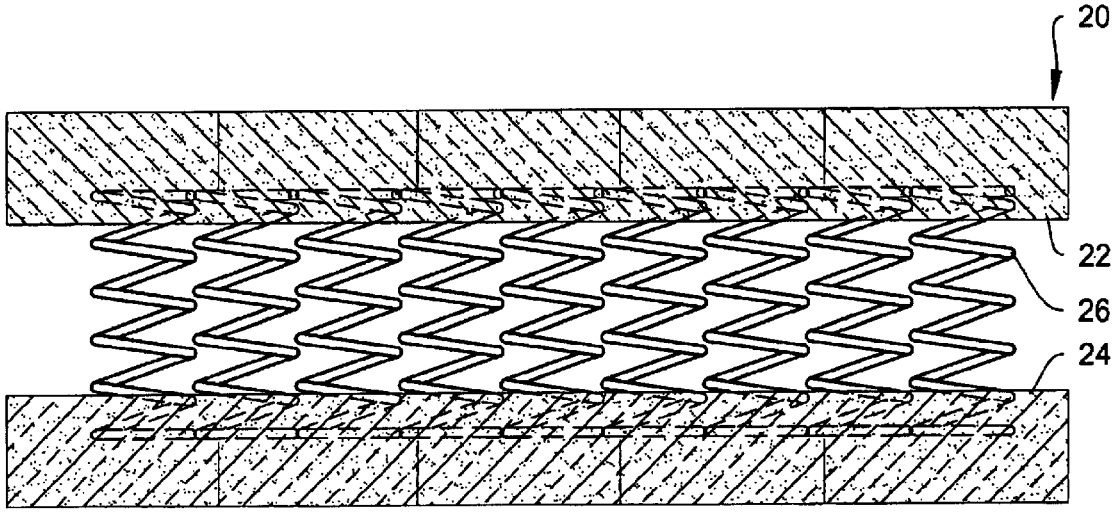
FIG. 3 shows a cross section of a mattress with coil ends embedded in a foam/rubber-like material.

The multi-strand coil springs described herein can be used, inter alia, to construct seating and resting surfaces of articles of furniture. In particular, the multi-strand coil construction can be a less expensive replacement for single strand or solid wire coils in mattresses, while providing the same utility and performance. For purpose of illustration, the coils described herein will be described with reference to pocketed coil mattresses; however the invention is not so limited and may be employed with open-coil mattresses, seat cushions, car seats, flooring, and other products.

FIG. 1 illustrates the basic geometric parameters defining the helical compression spring. The primary spring geometric design parameters are: Free Length ($L_O$) representing the length of the unloaded spring; Wire Diameter (d) representing the diameter of the wire that is wound into a helix; Coil Diameter (D) representing the mean diameter of the helix, i.e., $(D_{outer}+D_{inner})/2$; and Total Number of Coils ($N_t$) representing the number of turns in the spring. Other useful design parameters are: Active Coils ($N_a$) representing the number of coils which actually deform when the spring is loaded, as opposed to the inactive turns at each end which are in contact with the spring seat or base; Solid Length ($L_s$) representing the minimum length of the spring, when the load is sufficiently large to close all the gaps between the coils; and Pitch (p) representing the distance from center to center of the wire in adjacent active coils. Springs in seating and resting surfaces of articles of furniture typically employ closed end springs of the type illustrated in FIG. 1. Closed end springs are typically assumed to have at most one inactive coil at each end of the spring.

The selection of the spring material is usually the first step in parametric spring design. Material selection may be based on a number of factors, including temperature range, tensile strength, elastic modulus, fatigue life, corrosion resistance, cost, etc. High-carbon spring steels are the most commonly used of all springs materials. They are relatively inexpensive, readily available, and easily worked. Examples include Music Wire (ASTM A228) and Hard Drawn (ASTM A227) wire, which are suitable for springs used, for example, in mattresses. Spring wires can be surface-treated, such as galvanized or coated with a plastic or epoxy.

Spring wire used in mattress coil spring construction has typically a diameter of between approximately 0.06" (16 gauge) and approximately 0.09" (13 gauge), with each coil spring made of a single strand of spring wire. The exact design parameters for mattress coil springs depends on the desired firmness, which is in addition determined by the number of springs per unit surface area of the mattress. Both solid wire and multi-strand coils can be designed to have a variable spring rate, meaning that the spring excursion varies non-linearly with the applied load.

The proposed alternative coil spring construction for use in a seating or sleeping application employs a multi-strand coil spring which is made of at least 2 wire strands that are twisted to form a multi-wire cord. The number of strands employed will vary according to the application and may vary based on the type of material used to form the strand. Thus, the braided wire may include two or more strands, and typically will include from three to fifty strands. This multi-strand coil spring can be manufactured less expensively than a single-multi-strand coil spring, while retaining the advantageous performance characteristics of the single-multi-strand spring.

FIG. 2 shows schematically a closed end 3-cord multi-strand coil spring having an overall outside diameter of approximately 2" and $N_t$=6 coils, with one coil being an inactive coil, as defined above. An exemplary free length $L_O$ is between 5" and 6". The proposed spring can be made, for example, of carbon steel, such as ASTM A227/A228, with each strand having an outside diameter of 0.514" (1.3 mm), which is equivalent to a 17½ gauge. With these parameters, the spring rate is approximately 1.4 lb which gives the following characteristic:

| Working Deflection (inches) | Working Load (lbf) |
|---|---|
| 0.75 | 1.07 |
| 1.0 | 1.43 |
| 2.5 | 3.57 |
| 3.0 | 4.28 |

The fatigue performance of the illustrated multi-strand spring design is estimated to be between 100,000 and 1,000,000 operation cycles at 2.75" deflection, which corresponds to a useful life of approximately 15 years. The efficiency and performance of the spring is understood to increase with the number of strands. However, the cost also tends to increase with the number of strands. It has been estimated that the spring will suffer no more than 5% relaxation over 15 years when deflected by 2.75 ".

Multi-strand springs have the advantage of remaining functional even when one or more of the strands breaks. The strands may be twisted, weaved, clipped or bonded together and any suitable method for forming the multi-strand coil spring may be employed without departing from the scope of the invention. The strands may be steel, aluminum, plastic, copper, titanium, rubber or any other suitable material and the type of material selected will depend upon the application at hand. Morever, the strands may have any suitable shape and may be long cylindrical wires, hexagonal wire, square wire or any other shape or geometry. Additionally, the wire strand gauge may vary according to the application and in one embodiment comprises 710 gauge wire, although other gauges may be used.

The exemplary multi-strand coil spring illustrated in FIG. 2 can be fabricated by initially providing the individual wires (strands) with a helical twist prior to the stranding operation. The helix of the multi-strand spring itself preferably opposes the helix of the individual wires to counteract a tendency of the strand elements to loosen when the spring is operated, i.e., compressed. Additionally, as with conventional springs, a torque is applied to the cord wire during coiling.

In one practice, coiling may be achieved construction by passing a braided strand through a coiler, such as the type of coiler employed for forming steel mattress coils wherein a heavy-gauge steel wire is compressed into a barrel-shaped coil such that no turns touch for eliminating noise and vibration. The coils may then be passed to a pocketing machine or station to pocket the springs into individual sleeves of a non-woven, non-allergenic fabric such as Duon. Each sleeve may be ultrasonically sealed, a process where the fibers are melted together to form solid plastic seams that are secure and tear-resistant. The coils are then fusion bonded to produce a strong, stable construction. The number of coils in each unit may vary, and the types of coils and the number of strands and gauge of strands can vary from pocket to pocket.

The individual strands are connected with each other at least at the ends of the coil. Since the strands can rub against each other over the length of the coil, which can cause fretting and premature wear, the strands may be coated and/or pre-galvanized. Moreover, the multi-strand coil may also be sealed with a sealant, such as an epoxy. Thus, in alternative and optional embodiments, the strands may be coated or otherwise treated and the wire may be sealed or coated.

The exemplary multi-strand coil spring illustrated in FIG. 2 can also be fabricated using multi-strand wire wherein the various strands made of different materials, for example, different types of metals, such as bronze, titanium and the like, as well as various types of spring steels having different elastic properties. In this way, the elasticity of the spring, or the spring rate, can be tailored to specific applications without the need to acquire or stock a large quantity of conventional dissimilar coil wires. Other elastic materials having spring-like properties, for example suitable plastics, can also be used.

To lessen the risk of fretting of the stands, the strands can be selectively welded at predetermined locations along the length of the multi-strand wire, either when the multi-strand wire is fabricated or when the wire coil is being formed. The coil can thereafter be coated or galvanized along the multi-strand wire, or the entire coil could be encased in a foam-like or rubber-like material that can be poured or wrapped around the coil strings. Alternatively or in addition, a coil could be completely surrounded by a "block" of foam-like or rubber-like material, or the entire mattress core could be filled with foam. This can add lateral stability to the multi-strand coil springs and/or, if the foam is impervious to air, can protect the coil springs from environmental effects.

FIG. 3 depicts a section of a mattress 20 constructed with multi-strand wire coils 26 whereby additional support is provided by encasing at least the end sections of the springs in foam 22, 24. Other resilient materials, such as rubber and/or latex, can also be used. This arrangement obviates the need for connecting the ends of the springs individually to a frame or to each other and can furthermore provide a sleeping surface adapted for the comfort of a user. This construction may advantageously provide additional lateral support for the multi-strand coils.

Figure 4:
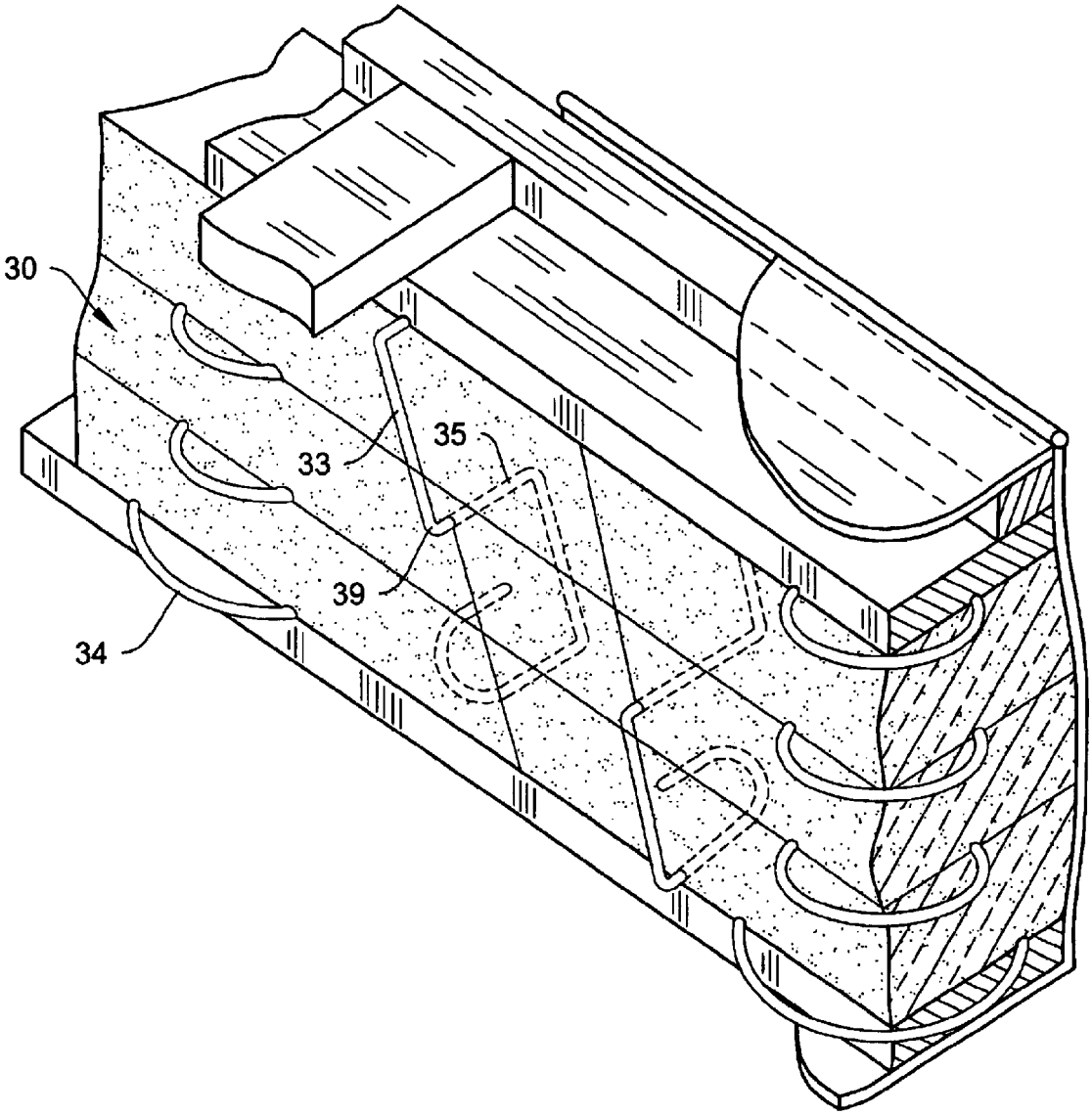
FIG. 4 is a fragmentary perspective view of springs inserted in a slotted foam/rubber support.
Figure 5:
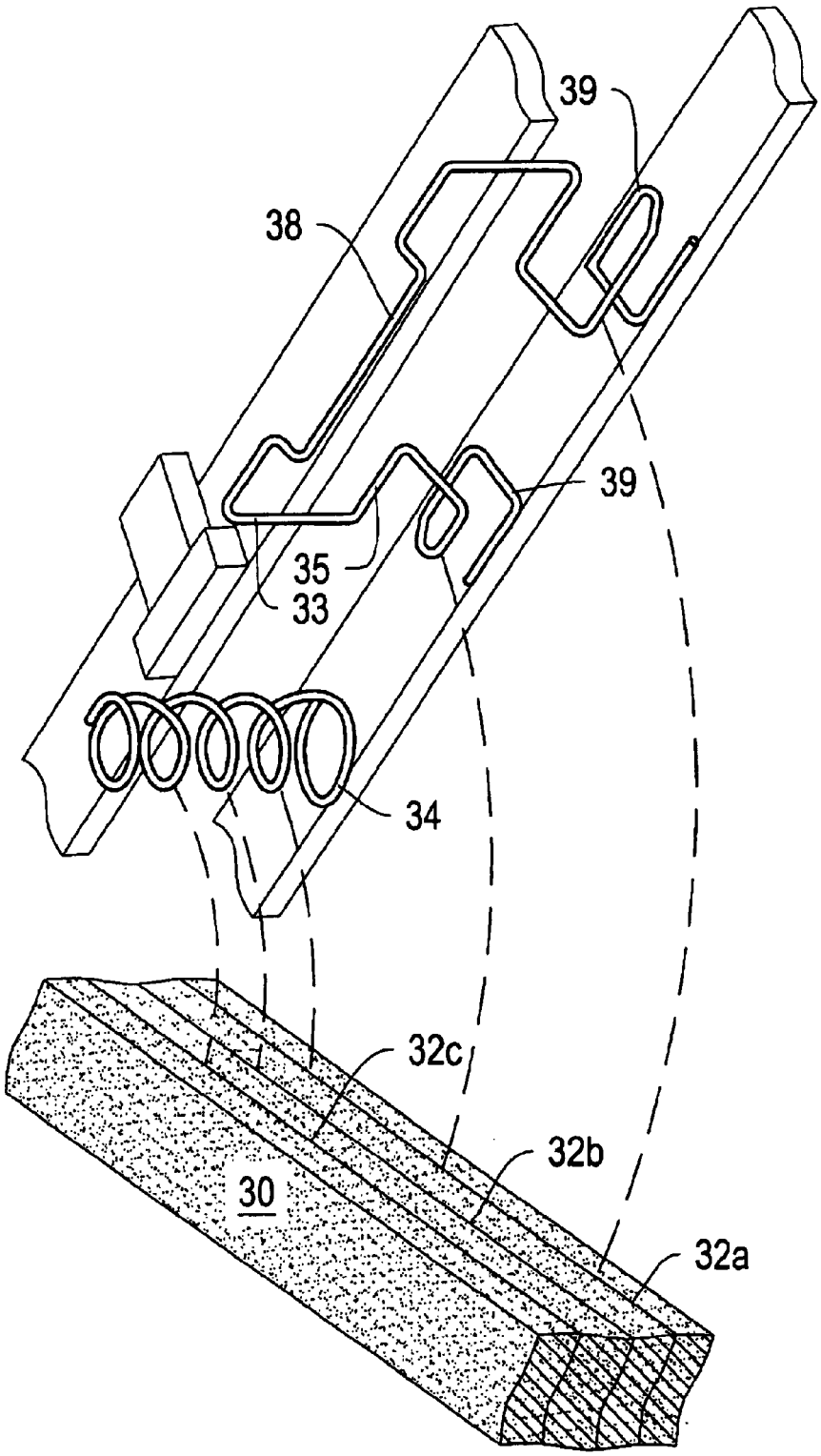
FIG. 5 is an exploded fragmentary perspective view of the springs and slotted foam/rubber support of FIG. 4.

Turning now to FIGS. 4 and 5, support for the multi-strand coil springs and the mattress construction in general may also be improved by placing foam 30 between or around the coil springs 34, for example, by slitting the foam 30 substantially parallel (32*a*, 32*b*, 32*c*) to the spring turns (see FIG. 5) and pressing the foam into the sides of the coil spring. This approach makes it possible to reduce the number of springs in a mattress, thereby reducing also the weight and the manufacturing costs of the mattress. The resiliency of the mattress which is related to the desired sleeping comfort of a user, can be further tailored to the user's needs by completely encasing the multi-strand coil springs in foam. A foam with sealed pores can furthermore protect the multi-strand coil spring from corrosion, which is even more important for multi-strand coil springs than for solid wire springs due to the larger surface-to-volume ratio of the multi-strand coil springs and potentially developing weak spot on the spring surface caused by fretting, as described above.

Multi-strand coil springs that are enclosed/encased in foam need not be arranged in a regular pattern and spring with different spring rates can be easily incorporated. In this way, a mattress having a different softness in different areas of the sleeping surface can be easily constructed. Since the foam-encased springs may not need additional mechanical reinforcement (in addition to the foam) and may not have to be interconnected, for example, by hog rings or tie wires, so that the mattress design can be implemented easily and quickly changed without additional tooling, which also reduces manufacturing costs.

As also seen in FIGS. 3 and 5, other types of spring elements 39, such as vertical springs, can also be fabricated of multi-strand wire and additionally supported by or encased in foam 30. The orientation of the slits can be arranged so as to match the orientation of the individual sections 33, 35 of the spring elements. Moreover, adjacent springs 34 and/or spring elements 39 can be connected in an alternating arrangement, whereby a top section of a spring element 39 is connected to the top section of an adjacent spring element 39 by cross-wire 38, with the bottom section of a top-connected spring element 39 then connected to a bottom section of the next spring element 39 (not shown), and so on. In this way, a succession of springs can be manufactured from a continuous wire (either solid or braided/stranded) without separating the individual springs.

Figure 6:
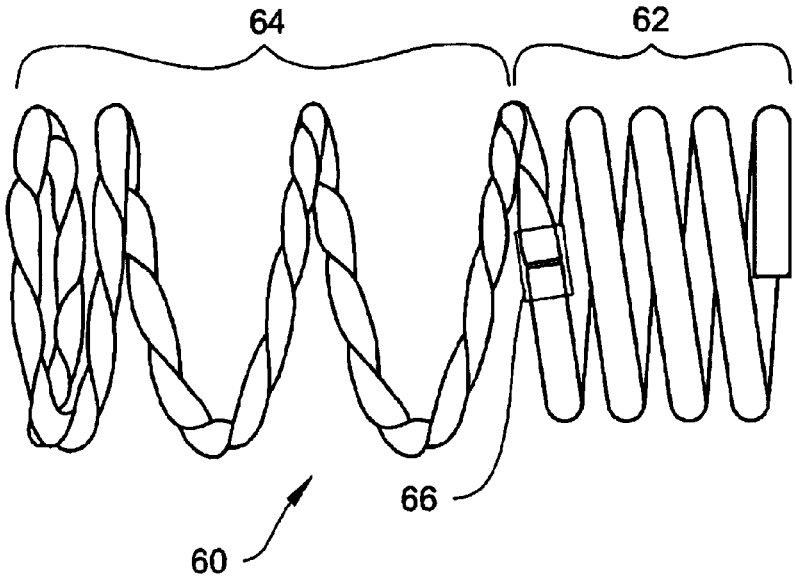
FIG. 6 shows an exemplary composite spring made of two spring segments.

FIG. 6 illustrates an exemplary embodiment of a spring 60 which can have a variable spring rate. Multi-strand wire coils can be employed in the design of such a spring. A spring 60 with a variable spring rate can provide a mattress sleeping surface that has a "soft" response if less pressure exerted by a user (i.e. if the weight of the user is relatively low), with the response becoming "harder" for heavier users. A first section 62 of the spring 60 could be manufactured from a solid coil wire having a first, typically lower spring rate (stiffer spring). A second section 64 can be implemented as a multi-strand coil wire and attached to an end of the section 62, for example, by crimping a sleeve 66 over the adjoining end portions of each section 62, 64. The sleeve 66 can be made of metal or a sturdy plastic that can withstand the applied torsion and other forces. Other means for connection the sections 62 and 64, with or without a sleeve 66, may include, for example, welding or brazing. Since for the same wire diameter multi-strand wire coil springs can have a greater spring rate than solid wire coil springs, the multi-strand wire coil 64 may be compressed first, giving the "softer" response, with the solid wire spring 62 thereafter providing the "harder" response. The response can be further adjusted by inserting foam (30; see FIGS. 4 and 5), as described above.

Figure 7:
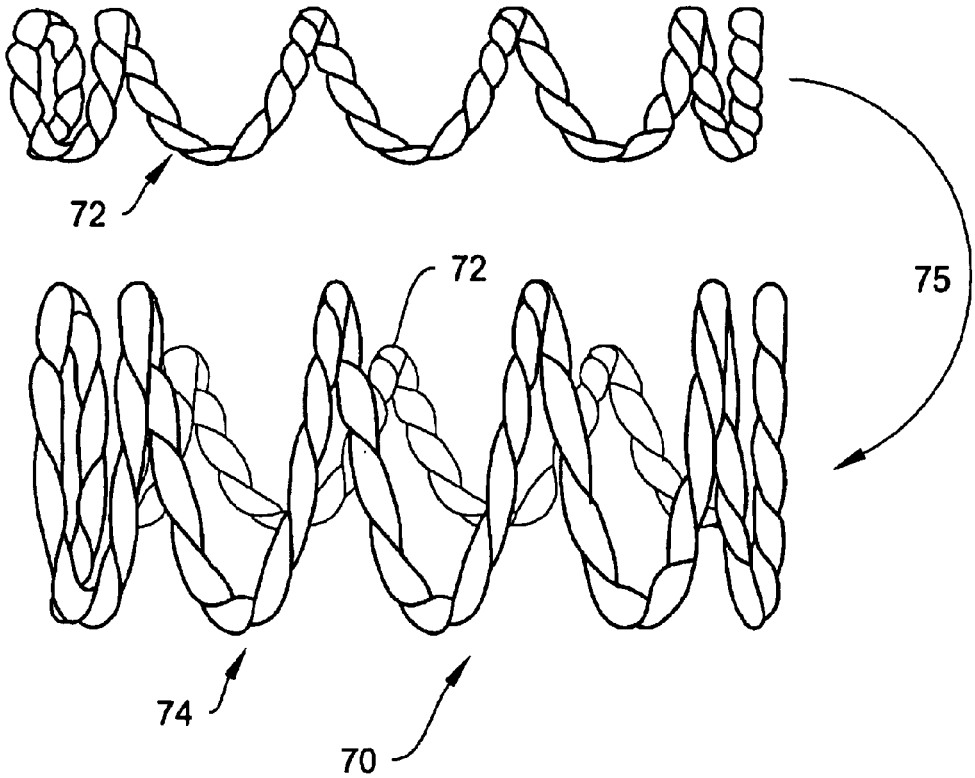
FIG. 7 shows a coil-in-coil spring assembly made of multi-strand coil springs.

In another exemplary embodiment depicted in FIG. 7, a multi-strand wire coil 72 may be inserted into and/or affixed inside another (multi-strand wire) coil spring 74 of a larger diameter. Either coil spring or both coil springs 72, 74 can be made of multi-strand wire, braided wire or solid wire, or can have the split coil configuration depicted in FIG. 6. In this way, a mattress core may be manufactured by first arranging outer coil springs in a desired pattern and then selectively placing multi-strand wire coils inside the outer coil springs. The inner coils can be secured to the outer coils in a conventional manner, for example, with hog rings, wire, straps, etc. The manufacture may be particularly simplified by using the foam construction depicted in FIGS. 3–5, in which case the inner coil springs may simply be placed inside the outer springs without additional mechanical attachment to the outer coil spring, before the foam is applied.

In another practice, a multi-strand wire of the type used to produce multi-strand wire coil springs can also be used as conventional border wire in mattress construction instead of a solid border wire. More generally, multi-strand wire and multi-strand wire coils can replace solid wire and solid wire coils in many applications, such as in yielding and non-yielding box springs or other mattress support structures. In yet another practice, alternatingly connected wire-type springs, as described above with reference to FIGS. 4 and 5, can be formed from multi-strand wire by employing a suitable coil winding machine that eliminates torsion in the feed wire, such as the coil winding machine disclosed in commonly assigned U.S. patent application Ser. No. 10/661,363, entitled "Methods for Manufacturing Coil Springs", which is incorporated herein by reference in its entirety. Such continuous coils from multi-strand wire may perform best if wound by maintaining the same winding sense between coils so as to prevent the individual strands from loosening during spring compression.

While the invention has been disclosed in connection with the illustrated embodiments shown and described in detail, various modifications and improvements thereon will become readily apparent to those skilled in the art. For example, the multi-strand springs described herein as coil springs can have other suitable shapes, diameters or heights. The mattresses can be one sided and unidirectional. They can be main springs and joey coils, and optionally provide for multiple firmness as well as gradients of firmness. The multi-strand coil springs can be used in pocketed coil mattresses and open-coil mattresses. They can be used in seat cushions, car seat cushions and sofas. Accordingly, the spirit and scope of the invention is to be limited only by the following claims.

What is claimed is:

1. A mattress assembly comprising a plurality of coil springs arranged to define a mattress core structure, at least one additional multi-strand coil spring fabricated of a plurality of wire strands and disposed inside a corresponding one of the coil springs of the mattress core structure, and a border wire, wherein at least part of the border wire is made of a multi-strand wire.

2. A mattress assembly comprising a plurality of coil springs arranged to define a mattress core structure, and a border wire, wherein at least part of the border wire is made of a multi-strand wire, wherein at least a subset of the coil springs comprises multi-strand coil springs fabricated of a plurality of wire strands and positioned in substantially parallel alignment to each of the coil springs that are not part of the subset, wherein the multi-strand coil springs and the coil springs that are not part of the subset are placed side-by-side.

3. The mattress assembly of claim 1 or 2, wherein at least one strand of the plurality of the wire strands is made of a different material than another of the wire strands.

4. The mattress assembly of claim 3, wherein the material is selected from the group consisting of steel, bronze and plastic.

5. The mattress assembly of claim 1 or 2, wherein at least a portion of the coil springs and the multi-strand coil springs is surrounded by a foam or rubber-like material.

6. The mattress assembly of claim 5 wherein the coil springs and the multi-strand coil springs are encased in a foam or rubber-like material.

7. A mattress assembly comprising a plurality of coil springs arranged to define a mattress core structure, wherein at least a subset of the coil springs comprises multi-strand coil springs fabricated of a plurality of wire strands and positioned side-by-side in substantially parallel alignment to each of the coil springs that are not part of the subset, wherein the coil springs that are not part of the subset are solid wire springs.

8. The mattress assembly of claim 1 or 2, wherein the coil springs comprise multi-strand coil springs.

9. The mattress assembly of claim 1 or 2, wherein the multi-strand coil springs have a different spring rate than the coil springs.

10. A mattress assembly comprising a plurality of coil springs arranged to define a mattress core structure, wherein at least a subset of the coil springs comprises a composite coil spring, with a first section of the composite coil spring being fabricated of a plurality of wire strands and a second section of the composite coil spring adjoining the first section in a longitudinal spring direction being fabricated of a solid coil wire, and wherein adjoining end portions of the first and second section are rigidly connected with each other.

11. The mattress assembly of claim 10 wherein the first and second section are connected with each other by placing a bushing over the end sections.

12. The mattress assembly of claim 10 wherein the first and second sections are connected with each other by a material connection.

13. The mattress assembly of claim 12 wherein the material connection comprises a welded or brazed joint.

14. The mattress assembly of claim 10, and further including a border wire, wherein at least part of the border wire is made of a multi-strand wire.

15. The mattress assembly of claim 1, wherein each of the wire strands has a helical twist with a direction that is opposite to a twist direction of the multi-strand coil spring.

16. The mattress assembly of one of claim 1, 2 or 10, comprising at least three wire strands.

17. The mattress assembly of one of claim 1, 2 or 10, wherein the multi-strand wires are provided with a protective coating selected from the group consisting of galvanized exterior, plastic and epoxy overcoating.

18. The mattress assembly of one of claim 1, 2 or 10, wherein the multi-strand coil spring is provided with a protective coating.

19. The mattress assembly of one of claim 1,2 or 10, wherein the multi-strand coil spring is constructed so as not to have a central cord.

20. The mattress assembly of one of claim 1, 2 or 10, wherein the mattress core comprises a pocketed coil mattress core.

21. The mattress assembly of one of claim 1, 2 or 10, wherein the mattress core comprises an open-coil mattress core.

22. A mattress assembly comprising a plurality of coil springs alternatingly connected to form a contiguous array of coil springs and arranged to define a mattress core structure, wherein at least a subset of the coil springs comprises multi-strand coil springs fabricated of a plurality of wire strands and positioned in substantially parallel alignment to each of the coil springs that are not part of the subset.

wherein the multi-strand coil springs and the coil springs that are not part of the subset are placed side-by-side.

23. A mattress assembly comprising a plurality of pocketed coil springs arranged to define a mattress core structure, and at least one additional multi-strand coil spring fabricated of a plurality of wire strands and disposed inside a corresponding one of the coil springs of the mattress core structure.

* * * * *